US007775286B2

(12) United States Patent
Duphorne

(10) Patent No.: US 7,775,286 B2
(45) Date of Patent: Aug. 17, 2010

(54) CONVERTIBLE DOWNHOLE DEVICES AND METHOD OF PERFORMING DOWNHOLE OPERATIONS USING CONVERTIBLE DOWNHOLE DEVICES

(75) Inventor: Darin H. Duphorne, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 134 days.

(21) Appl. No.: 12/221,746

(22) Filed: Aug. 6, 2008

(65) Prior Publication Data

US 2010/0032151 A1 Feb. 11, 2010

(51) Int. Cl.
*E21B 43/00* (2006.01)
*E21B 29/00* (2006.01)
*E21B 33/14* (2006.01)

(52) U.S. Cl. ..... 166/376; 166/102; 166/192

(58) Field of Classification Search ..... 166/376, 166/102, 192
See application file for complete search history.

(56) References Cited

U.S. PATENT DOCUMENTS 3,211,232 A 10/1965 Grimmer
4,537,255 A 8/1985 Regalbuto et al.
4,949,788 A 8/1990 Szarka et al.
4,991,654 A 2/1991 Brandell et al.
5,333,689 A 8/1994 Jones et al.
5,479,986 A * 1/1996 Gano et al. ..... 166/292
5,501,276 A 3/1996 Weaver et al.
5,558,153 A 9/1996 Holcombe et al.
5,607,017 A * 3/1997 Owens et al. ..... 166/288
5,623,993 A 4/1997 Van Buskirk et al.
5,685,372 A * 11/1997 Gano ..... 166/292
5,709,269 A 1/1998 Head
5,765,641 A * 6/1998 Shy et al. ..... 166/292
6,026,903 A * 2/2000 Shy et al. ..... 166/292
6,062,310 A 5/2000 Wesson et al.
6,076,600 A * 6/2000 Vick, Jr. et al. ..... 166/192
6,161,622 A * 12/2000 Robb et al. ..... 166/386
6,220,350 B1 * 4/2001 Brothers et al. ..... 166/192

(Continued)

OTHER PUBLICATIONS

D.W. Thomson, et al., Design and Installation of a Cost-Effective Completion System for Horizontal Chalk Wells Where Multiple Zones Require Acid Stimulation, SPE Drilling & Completion, Sep. 1998, pp. 151-156, Offshore Technology Conference, U.S.A.

(Continued)

*Primary Examiner*—Jennifer H Gay
(74) *Attorney, Agent, or Firm*—Greenberg Traurig LLP; Anthony F. Matheny

(57) ABSTRACT

A convertible downhole device comprises at least one sacrificial material to provide two or more configurations so that two or more different operations or functions are performable by the downhole device, one in which the sacrificial material is fully intact and another in which the sacrificial material is at least partially removed or disappeared. The sacrificial material may be removable through any suitable method or device, such as by contacting with a fluid, by temperature, by pressure, or by combustion, ignition, or activation of a fusible or energetic material, or crushing or breaking up of a frangible material. Upon removal of the sacrificial material, the downhole device has at least one additional configuration so that at least a second operation can be performed by the downhole device.

20 Claims, 7 Drawing Sheets

U.S. PATENT DOCUMENTS

| | | | | |
|---|---|---|---|---|
| 6,289,991 | B1 | 9/2001 | French | |
| 6,397,950 | B1 * | 6/2002 | Streich et al. | 166/376 |
| 6,431,276 | B1 * | 8/2002 | Robb et al. | 166/192 |
| 6,926,086 | B2 | 8/2005 | Patterson et al. | |
| 7,093,664 | B2 * | 8/2006 | Todd et al. | 166/376 |
| 7,325,617 | B2 * | 2/2008 | Murray | 166/376 |
| 7,350,582 | B2 * | 4/2008 | McKeachnie et al. | 166/373 |
| 7,353,879 | B2 * | 4/2008 | Todd et al. | 166/376 |
| 7,395,856 | B2 * | 7/2008 | Murray | 166/192 |
| 7,464,764 | B2 * | 12/2008 | Xu | 166/376 |
| 7,625,846 | B2 * | 12/2009 | Cooke, Jr. | 507/260 |
| 7,628,210 | B2 * | 12/2009 | Avant et al. | 166/373 |
| 7,644,772 | B2 * | 1/2010 | Avant et al. | 166/373 |
| 2003/0141064 | A1 | 7/2003 | Roberson, Jr. | |
| 2003/0168214 | A1 * | 9/2003 | Sollesnes | 166/250.08 |
| 2005/0092363 | A1 * | 5/2005 | Richard et al. | 137/73 |
| 2005/0161224 | A1 | 7/2005 | Starr et al. | |
| 2005/0205264 | A1 | 9/2005 | Starr et al. | |
| 2005/0205265 | A1 * | 9/2005 | Todd et al. | 166/376 |
| 2005/0205266 | A1 * | 9/2005 | Todd et al. | 166/376 |
| 2005/0281968 | A1 | 12/2005 | Shanholtz et al. | |
| 2006/0021748 | A1 | 2/2006 | Swor et al. | |
| 2006/0131031 | A1 | 6/2006 | McKeachnie et al. | |
| 2006/0266518 | A1 | 11/2006 | Woloson | |
| 2007/0074873 | A1 * | 4/2007 | McKeachnie et al. | 166/376 |
| 2008/0066923 | A1 * | 3/2008 | Xu | 166/376 |
| 2008/0066924 | A1 * | 3/2008 | Xu | 166/376 |
| 2009/0044948 | A1 * | 2/2009 | Avant et al. | 166/329 |
| 2009/0107684 | A1 * | 4/2009 | Cooke, Jr. | 166/376 |
| 2010/0032151 | A1 * | 2/2010 | Duphorne | 166/55 |

OTHER PUBLICATIONS

H.A. Nasr-El-Din, et al., Laboratory Evaluation Biosealers, Feb. 13, 2001, pp. 1-11, SPE 65017, Society of Petroleum Engineers Inc., U.S.A.

X. Li, et al., An Integrated Transport Model for BallSealer Diversion in Vertical and Horizontal Wells, Oct. 9, 2005, pp. 1-9, SPE 96339, Society of Petroleum Engineers, U.S.A.

* cited by examiner

CONVERTIBLE DOWNHOLE DEVICES AND METHOD OF PERFORMING DOWNHOLE OPERATIONS USING CONVERTIBLE DOWNHOLE DEVICES

BACKGROUND

1. Field of Invention

The invention is directed to downhole devices for wellbores such as oil and gas wells that are constructed at least partially out of a sacrificial or disappearing material so that the downhole devices can be converted from providing a first downhole operation to providing a second downhole operation upon removal of the sacrificial material.

2. Description of Art

Downhole devices such as bridge plugs and ball seats are known the art. Generally, these downhole devices are disposed within a wellbore to allow certain downhole operations to be performed. For example, the bridge plug allows for isolation of the wellbore so that elevated pressures can be achieved above the bridge plug to actuate downhole tools, run fracturing operations, or to run other wellbore completion operations. Similarly, ball seats allow fluid flow to be either blocked or restricted or to permit flow through the wellbore depending upon whether a plug or ball is landed on the seat.

Both of these downhole devices have a single configuration for performing the respective functions or operations downhole. Additionally, after both of these and other downhole devices have been used for their respective downhole operations, the bridge plug or ball, or ball seat must be removed so that further downhole operations can be performed. Generally, these devices are milled out of the wellbore requiring a separate downhole tool run which can be time consuming and costly.

SUMMARY OF INVENTION

Broadly, downhole devices comprise a sacrificial or disappearing material so that the downhole devices are capable of performing a first downhole operation or function when the sacrificial material is intact, e.g., not removed, and performing a second downhole operation or function when the sacrificial material has disappeared or been removed. In various particular embodiments, the sacrificial material comprises one or more of an energetic material that is inherently energized to be removed by activation of the energetic material, by a fusible material capable of being removed by burning or combusting, a frangible material that is removed by breaking up into smaller pieces such as by exerting high pressures on the sacrificial material, by applying compressive pressure from explosive charges, a material that dissolves, e.g., liquefies or becomes a gas, when contacted with a solvent or other fluid, and the like. All of the foregoing examples of materials are included in the definition of "sacrificial materials" as that term is used herein.

In certain embodiments, no sacrificial material remains as part of the downhole device when the downhole device is converted from providing its first operation or function to providing its second operation or function. However, in specific embodiments, the downhole device can be designed such that a certain portion of the sacrificial material remains as part of the downhole device when the downhole device is providing its second operation or function.

Broadly, the downhole devices comprise a sacrificial material that is capable of providing the downhole device with the ability to provide a first downhole function or operation when the sacrificial material is in a first position and a second downhole function or operation when the sacrificial material is in a second position. In certain embodiments, the entire downhole device is formed out of the sacrificial material such that, when initially formed, the downhole device comprises a first configuration that provides the first operation and then, over time, the downhole device is re-configured by the sacrificial material to form a second configuration capable of performing the second operation. In other particular embodiments, the downhole device comprises a non-sacrificial material and a sacrificial material such that, when initially assembled, the downhole device has a first configuration that provides the first operation due to the sacrificial material not yet being removed and then, after completion of the first operation, the sacrificial material is removed to leave behind a downhole device comprising a second configuration formed by the non-sacrificial material which is capable of performing the second operation.

In one specific embodiment, the downhole device is initially a bridge plug that performs a downhole wellbore operation such as enabling hydraulic pressure in a tubular disposed within the wellbore to set packers or provide fracturing operations the like to complete the wellbore. Following such an operation, it may be desirable to provide a shoulder or other landing, such as a ball seat for a plug such as a ball to land or seat for a subsequent operation within the wellbore.

In the specific embodiment where the downhole device first functions as a bridge plug and subsequently functions as a ball seat, the bridge plug is located within a wellbore at in proximity to where a ball seat is desired. The bridge plug comprises at least a portion that comprises a first material, which may or may not be sacrificial, and which provides the desired ball seat. A second portion of the bridge plug comprises a second material that is sacrificial, e.g., a sacrificial material as that term is used herein, that completes the design or configuration of the bridge plug and is adjacent to the desired ball seat. After the bridge plug is no longer needed and a ball seat is needed, the sacrificial material is removed which causes the downhole device to be converted from a bridge plug (the first configuration of this particular embodiment of the downhole device) to a ball seat (the second configuration of this particular embodiment of the downhole device).

In other certain embodiments, the downhole device is integral to or connected directly to tubing or casing. In still other embodiments, one or all of the downhole wellbore operations are "mechanical" operations, e.g., those involving or facilitating actuation, movement, or engagement, or the like, of a structure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The downhole devices comprise, at least partially, a sacrificial material such that, prior to the removal of the sacrificial material, the device has a first configuration to serve a first purpose (or performs a first function or operation), and after the removal of the sacrificial material, the device has a second configuration to serve a second purpose (or performs a second function or operation).

Figure 1:
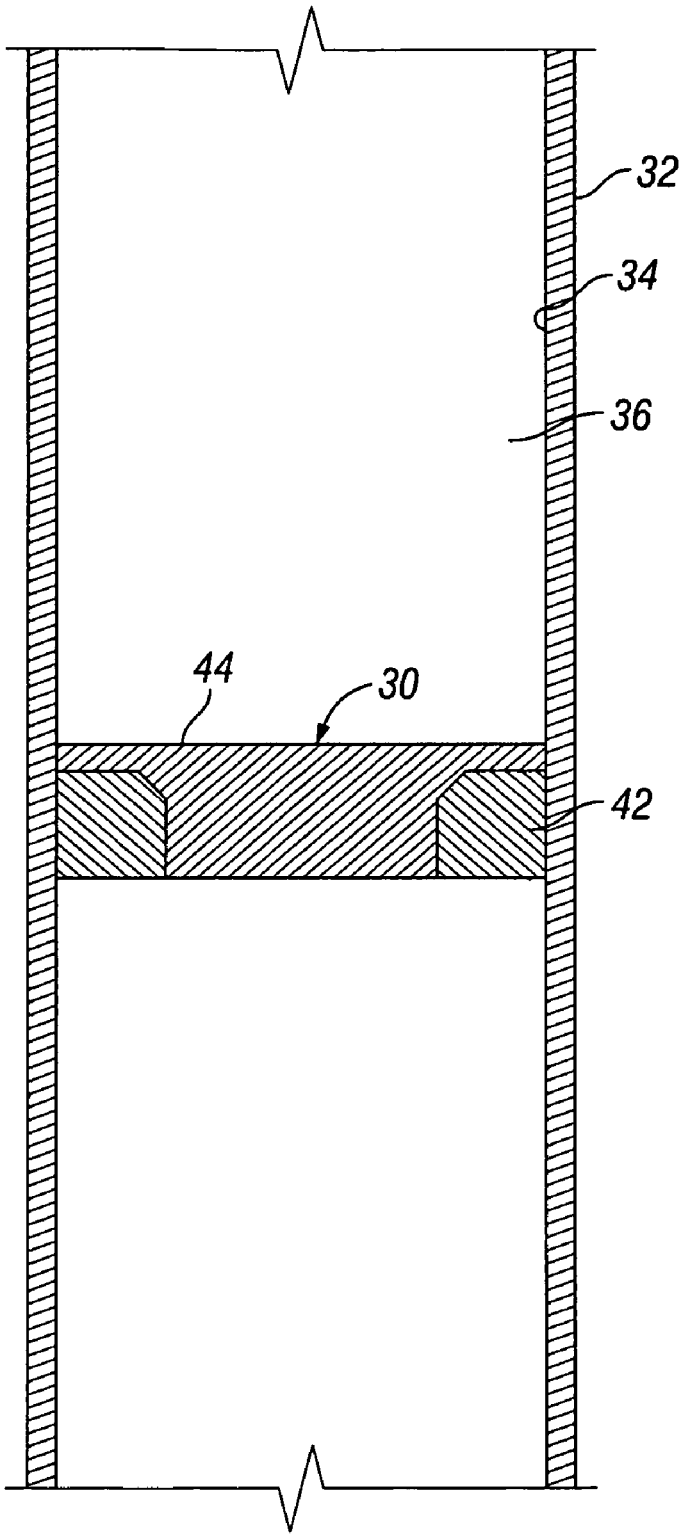
FIG. 1 is a cross-sectional side view of one specific embodiment of a downhole device disposed in a wellbore, the downhole device being shown as having a sacrificial material and first configuration to so that a first downhole operation is performable.
Figure 2:
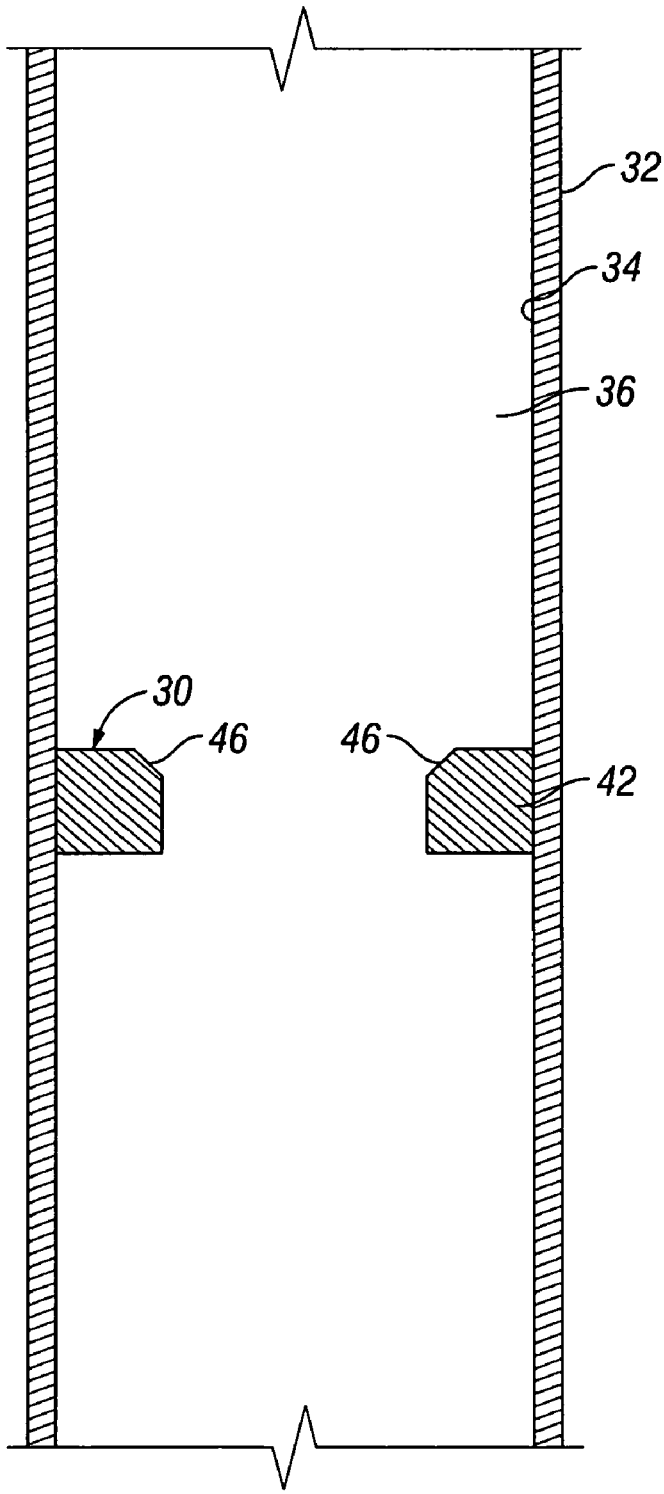
FIG. 2 is a cross-sectional side view of the downhole device of FIG. 1 disposed in a wellbore, the downhole device being shown as having a second configuration after removal of the sacrificial material to so that a second downhole operation is performable.

For example, as shown in FIGS. 1-2, in one specific embodiment, downhole device 30 is shown disposed within wellbore 32 which comprises inner wellbore wall surface 34 and bore 36. Downhole device 30 includes first portion 42 and second portion 44 so that downhole device 30 has a first configuration which, in this embodiment, is a bridge plug. In the embodiment shown in FIGS. 1-2, second portion 44 comprises a sacrificial material.

The sacrificial materials described herein can be formed out of any material that is capable of being removed from the downhole device such that the downhole device is converted from providing a first operation or function, such as bridge plug, to a second operation or function, such as a ball seat. "Sacrificial" as used herein comprises any material capable of disappearing or being removed such as through application of temperature, pressure, contact with a fluid, being combusted, being exploded, or being broken up. "Sacrificial" is understood to encompass the terms, but not be limited to the terms, dissolvable, degradable, combustible, and disintegrable as well as materials that are capable of being "removed," "degraded," "combusted," "fractured," "detonated," "deflagrated," "disintegrated," "degradation," "combustion," "explosion," and "disintegration."

In one specific embodiment, the sacrificial material is one that is capable of dissolution in a fluid or solvent disposed within bore 36 of wellbore and, thus, placed in contact with second portion 44. In particular embodiments, the sacrificial material is removable by a temperature or fluid such as water-based drilling fluids, hydrocarbon-based drilling fluids, or natural gas (collectively "fluid sacrificial materials"), and that could be, but are not required to be, calibrated such that the amount of time necessary for the sacrificial material to be removed is known or easily determinable without undue experimentation. Suitable sacrificial materials include polymers and biodegradable polymers, for example, polyvinyl-alcohol based polymers such as the polymer HYDROCENE™ available from Idroplax, S.r.l. located in Altopascia, Italy, polylactide ("PLA") polymer 4060D from Nature-Works™, a division of Cargill Dow LLC; TLF-6267 polyglycolic acid ("PGA") from DuPont Specialty Chemicals; polycaprolactams and mixtures of PLA and PGA; solid acids, such as sulfamic acid, trichloroacetic acid, and citric acid, held together with a wax or other suitable binder material; polyethylene homopolymers and paraffin waxes; polyalkylene oxides, such as polyethylene oxides, and polyalkylene glycols, such as polyethylene glycols. These polymers may be preferred in water-based drilling fluids because they are slowly soluble in water.

In calibrating the rate of removal of such sacrificial materials, generally the rate is dependent on the molecular weight of the polymers. Acceptable removal rates can be achieved with a molecular weight range of 100,000 to 7,000,000. Thus, removal rates for a temperature range of 50° C. to 250° C. can be designed with the appropriate molecular weight or mixture of molecular weights.

In one embodiment the sacrificial material dissolves, degrades, or disintegrates over a period of time ranging from 1 hour to 240 hours and over a temperature range from about 50° C. to 250° C. In other embodiments, both time in contact with a solvent and temperature act together to remove the sacrificial material; however, the temperature should be less than the melting point of the sacrificial material. Thus, the sacrificial material does not begin disappearing solely by coming into contact with the solvent which may be present in the wellbore during running in of downhole device 30. Instead, an elevated temperature may also be required to facilitate removal of the sacrificial material by the solvent. Additionally, water or some other chemical could be used alone or in combination with time and/or temperature to remove the sacrificial material. Other fluids that may be used to remove the sacrificial material include alcohols, mutual solvents, and fuel oils such as diesel.

It is to be understood that the apparatuses and methods disclosed herein are considered successful if the sacrificial material is removed sufficiently such that downhole device 30 is converted from a first configuration in which a first operation is performable to a second configuration in which a second operation is performable. In other words, the apparatuses and methods are effective even if all of the sacrificial material is not completely removed. To the contrary, in certain embodiments, the second configuration is formed before all of the sacrificial material is removed which, in certain embodiments, allows for a third configuration to be formed after all of the sacrificial material is removed.

Other sacrificial materials comprise composite energetic materials that can be deflagrated or detonated upon proper initiation. These energetic materials typically include an energetic resin and a reinforcement filler. Suitable energetic materials are described in greater detail, including methods of activation of these energetic materials, in U.S. Published Patent Application No. 2005/0281968 A1 which is hereby incorporated by reference herein in its entirety.

Still other suitable sacrificial materials are frangible materials such as non-metallic filamentary or fiber reinforced composite materials that are reducible to a fine particulate matter when subjected to an explosive force. Examples include, but are not limited to graphite reinforced epoxy or glass reinforced epoxy. Breaking or reducing the frangible materials into a fine particulate matter can be accomplished through any method or device know in the art, such as the use of an explosive charge and detonator operatively associated with the sacrificial material and a firing mechanism operatively associated with the detonator and explosive charge in a manner similarly described in U.S. Pat. No. 4,537,255 which is hereby incorporated by reference herein in its entirety or as described in U.S. Published Patent Application No. US 2003/0168214 A1, which is also hereby incorporated by reference herein in its entirety.

Yet other suitable sacrificial materials include "fusible materials" such as those that burn or combust due to a chemical reaction between fluid in the wellbore being exposed to the fusible material, such as water in the wellbore contacting the fusible material comprising one or more of potassium, magnesium, or sodium, or as a result of a temperature increase caused by the wellbore itself, or by friction being applied to the fusible material. One specific fusible material is PYROFUZE® available from Sigmund Cohn Corp. of Mount Vernon, N.Y. The PYROFUZE® fusible material consists of two metallic elements in intimate contact with each other. When the two elements are brought to the initiating temperature, or selected temperature increase, they alloy rapidly resulting in instant deflagration without support of oxygen. The reaction end products consist normally of tiny discreet particles of the alloy of the two metallic elements. Therefore, after the fusible material combusts, the area and volume in which fusible material was previous disposed becomes void thereby providing a different configuration of the downhole device.

Referring back to FIGS. 1-2, after the bridge plug downhole device 30 has performed its function or operation within the wellbore, instead of milling out the downhole device 30, second portion 44 is removed such as through the dissolution of the sacrificial material which makes up at least a portion of second portion 44. Upon removal of the sacrificial material in this specific embodiment, second portion 44 is completely removed leaving behind first portion 42 (FIG. 2). In the embodiment of FIGS. 1-2, first portion 42 includes landing surface or seat 46 (FIG. 2) for receiving a plug or ball (not shown). Thus, after removal of second portion 44, downhole device 30 comprises a second configuration so that a second downhole operation or function can be performed.

In operation of one particular bridge plug/ball seat embodiment, the bridge plug is set within the wellbore to perform its intended operation, e.g., allow pressure to build-up in the wellbore to set a packer or actuate another downhole device. Thereafter, the sacrificial material portion of the bridge plug is removed, such as by energizing the material, fracturing the material, or liquefying the material, to cause the sacrificial material to disappear leaving only a non-sacrificial portion behind. This non-sacrificial portion can be formed in the shape of a ball seat so that it can receive a ball so that further downhole operations can be performed.

As noted above, the downhole devices are not required to include a "non-sacrificial" portion. Instead, the first and second portions of the downhole device may both be formed out of a sacrificial material, however, one such portion may be removed through a different mechanism or by taking a longer time to remove as compared to the other portion. For example, first and second portions 42, 44 of the embodiment of FIGS. 1-2 may be formed out of a sacrificial material that dissolves in the presence of hydrocarbons in the wellbore. Second portion 44, however, is designed such that it dissolves at a faster rate than first portion 42. Thus, downhole device 30 can be placed within wellbore 32, the first operation performed prior to second portion 44 dissolving, second portion 44 then dissolving leaving first portion 42 so that the second operation can be performed and then, thereafter, first portion 42 dissolves. Alternatively, second portion 44 may be formed out of a "dissolvable" sacrificial material and first portion 42 may be formed out of an "energetic" sacrificial material. Or, as is recognizable by persons of skill in the art, any combination of different types of sacrificial materials may be used as desired or necessary so that each portion or portions of downhole device 30 for each function or operation are provided.

In another embodiment, first portion 42 can be formed out of a non-sacrificial material such as a metal that must be milled out of wellbore 32 to remove it from bore 36.

Further, first portion 42 and second portion 44 may be contacting one another, connected to one another, formed integral with each other (although being formed out of different materials as discussed above), radially contiguous with each other, axially contiguous with each other, and the like.

Figure 3:
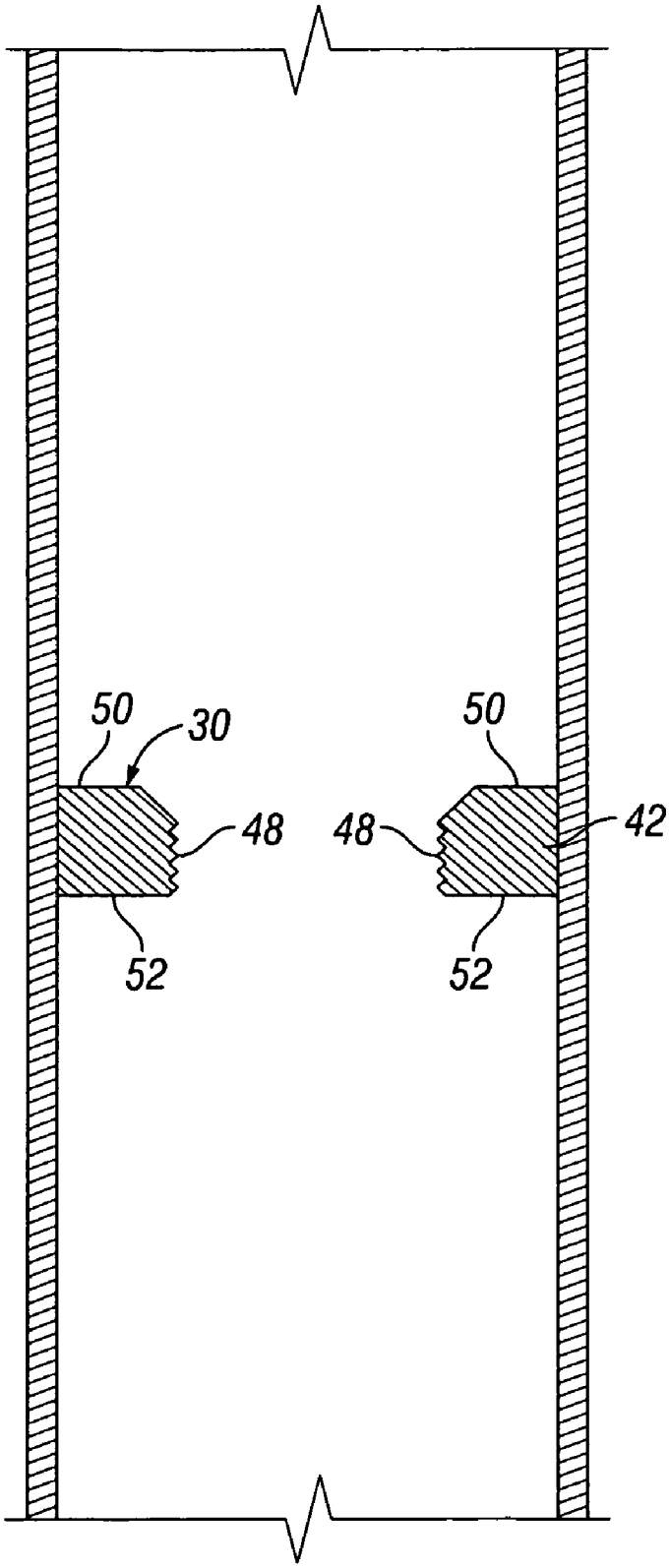
FIG. 3 is a cross-sectional side view of another specific embodiment of a downhole device shown disposed in a wellbore, the downhole device being shown as having a second configuration after removal of the sacrificial material to so that a second downhole operation is performable.

Referring now to FIG. 3, in other particular embodiments first portion 42 comprises one or more of fastener 48, upper surface 50 and/or lower surface 52 that facilitate additional downhole operations. For example, fastener 48 may be used to connect a downhole component such as a downhole tool, e.g., a cross-over tool, to facilitate anchoring the downhole component within bore 36 of wellbore 32. Although fastener 48 is shown in FIG. 3 as threads, fastener 48 can comprise any other attachment or connection member regardless of whether fastener 48 allows the downhole component to be connected to and subsequently released from first portion 42.

In another embodiment, upper surface 50 can provide a landing surface for tubing, a work string, a downhole tool, or other downhole component so that further downhole operations can be performed above downhole device 30. In an additional embodiment, lower surface 52 can provide a downward direction resistive force for a wireline pump lowered through first portion 42 and then radially expanded and pulled upward to engage lower surface 52 so that the wireline can have a resistive downward force to allow the pump to be actuated by up and down movement of the wireline to inflate a packer or actuate or inflate another wireline component.

In still another embodiment, the opening in first portion 42 can be plugged for additional downhole operations.

In yet another embodiment, upper surface 50 may have a profile, such as nipple profile, for receiving a collet, running tool, or the like. Likewise, lower surface 52 or the inner diameter where fastener 48 is shown in FIG. 3 may include such a profile or the like for receiving components of other downhole tools.

Figure 5:
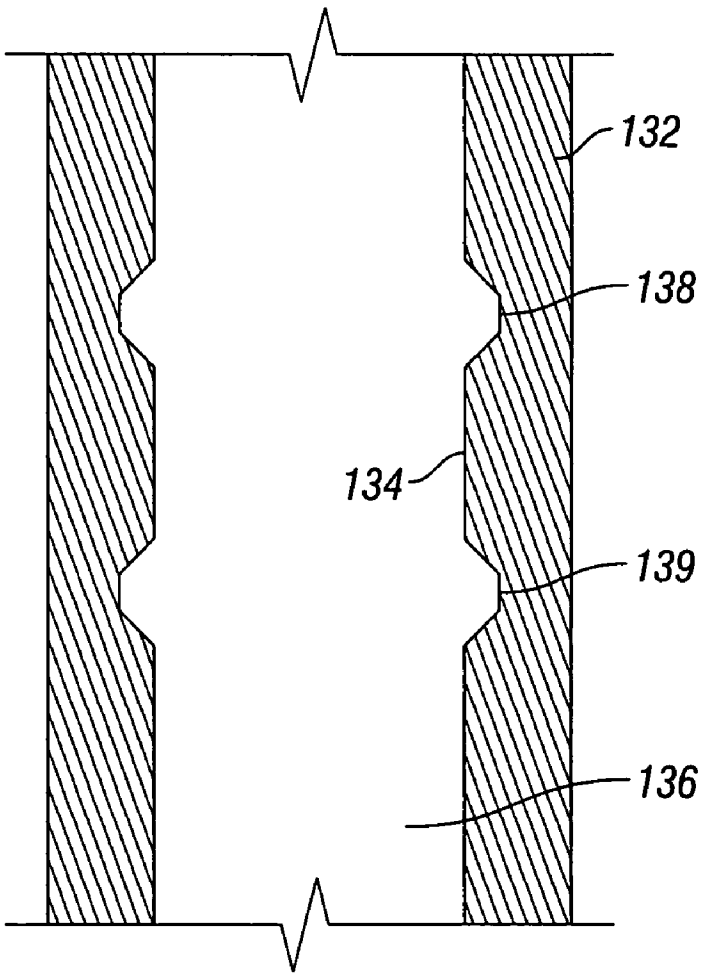
FIG. 5 is a cross-sectional side view of the downhole device of FIG. 4, the downhole device being shown as having a second configuration after removal of the sacrificial material to so that a second downhole operation is performable.
Figure 4:
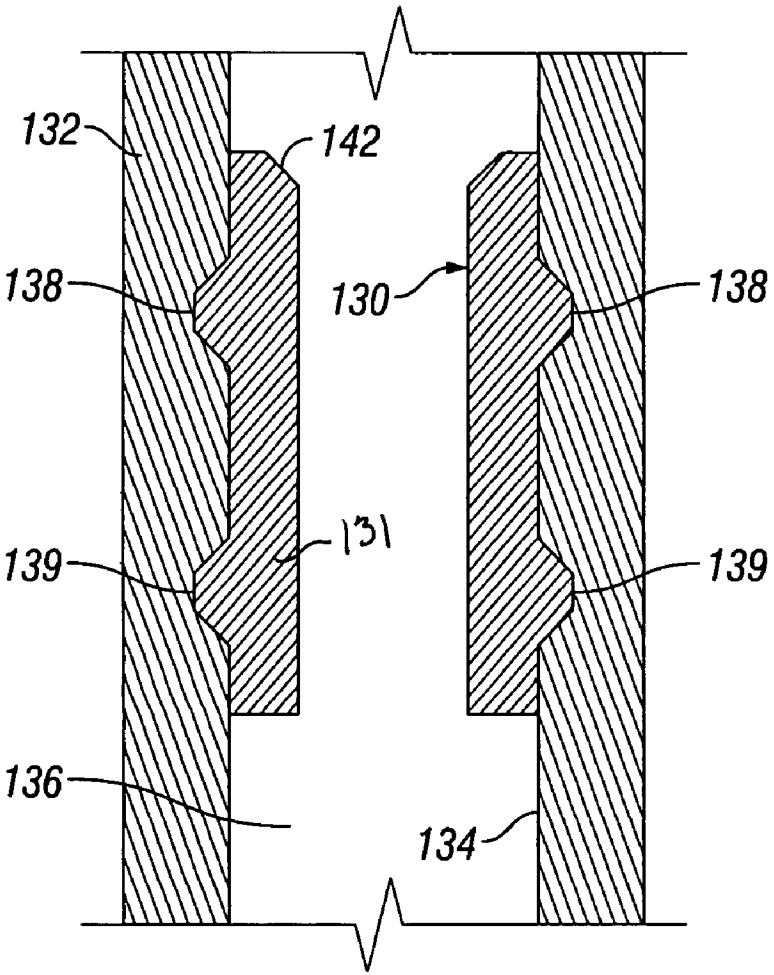
FIG. 4 is a cross-sectional side view of an additional specific embodiment of a downhole device, the downhole device being shown as having a sacrificial material and first configuration to so that a first downhole operation is performable.

Referring now to FIGS. 4-5, in another embodiment, downhole device 130 is shown as wellbore tubular 132 which comprises inner wellbore tubular wall surface 134, bore 136, and profiles 138, 139 disposed along inner wellbore tubular wall surface 134. Profiles 138, 139 can be engagement profiles, setting profiles, or location profiles such that downhole tools (not shown) can be run into wellbore tubular 132 to contact with profiles 138, 139 to, for example, engage the downhole tool with the wellbore, to actuate or "set" a downhole tool, or to communicate the location of the downhole tool within wellbore tubular 132 to an operator at the surface of the wellbore. Profiles such as profiles 138, 139 are known in the art, as well as their use in downhole operations.

In the embodiment shown in FIGS. 4-5, downhole device 130 comprises a sacrificial material portion 131 that form ball seat 142 (FIG. 4). After ball seat 142 has provided its function, sacrificial material portion 131 is removed through one or more of the methods described above (FIG. 5). As a result of the removal of sacrificial material portion 131, profiles 138 and 139 are no longer "filled" or blocked by ball seat 142. Thereafter, a second downhole operation, such as running a downhole tool (not shown) into wellbore tubular 132 until the downhole tool engages or contacts profiles 138, 139.

In one particular embodiment, the downhole tool includes a collapsible collet that permits radial expansion and contraction of one or more protrusions or "nipples" disposed on the downhole tool that expand into profiles 138, 139 when the downhole tool is properly aligned with profiles 138, 139 so that the operator of the downhole tool can, for example, actuate or set a downhole tool or communicate to the operator of downhole tool the location of the downhole tool within wellbore tubular 132. In another specific embodiment, the downhole tool comprises at least one dawg that is hydraulically actuated to engage profiles 138, 139. As noted above, the function of profiles 138, 139, as well as their use in connection with various downhole tools are known in the art.

Figure 7:
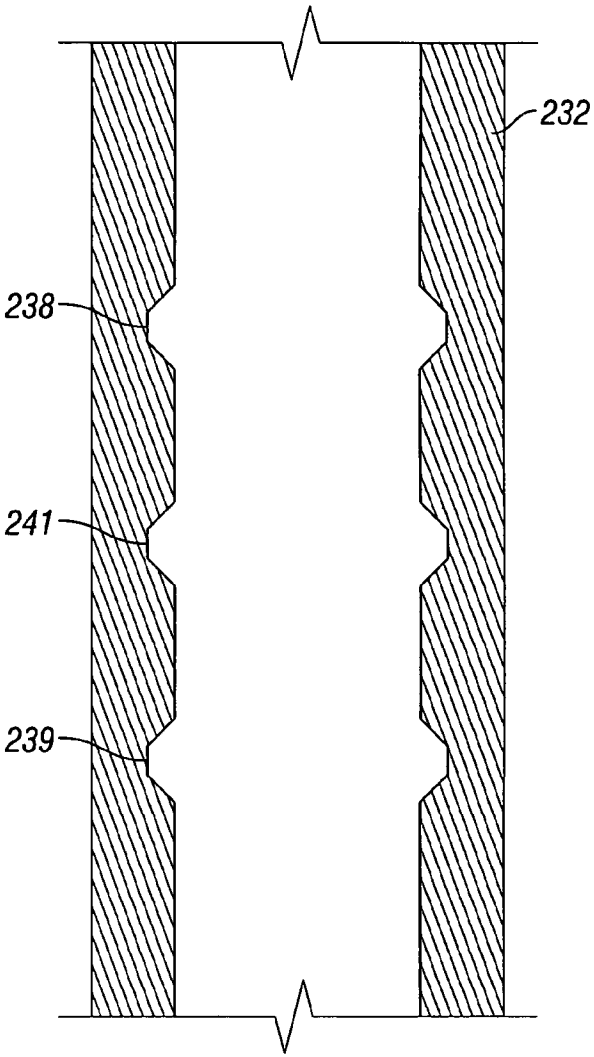
FIG. 7 is a cross-sectional side view of the downhole device of FIG. 6, the downhole device being shown as having a second configuration after removal of the sacrificial material to so that a second downhole operation is performable.
Figure 6:
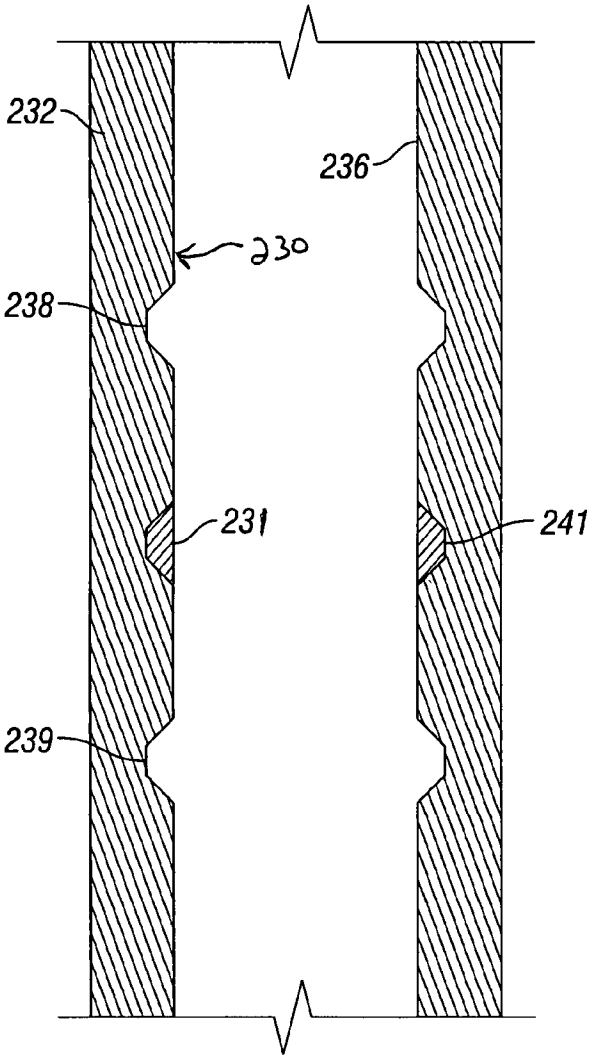
FIG. 6 is a cross-sectional side view of an additional specific embodiment of a downhole device, the downhole device being shown as having a sacrificial material and first configuration to so that a first downhole operation is performable.

As illustrated in FIGS. 6-7, in another specific embodiment, inner wellbore tubular wall surface 236 of wellbore tubular 232 of downhole device 230 initially comprises profiles 238, 239 for receiving a downhole tool (not shown) in the same manner as described above. Downhole device 230 comprises sacrificial material portion 231 and is disposed within a third profile 241 (FIG. 6). In this arrangement, a downhole tool (not shown) can be run into wellbore tubular 232 to engage or contact profiles 238, 239 to perform a first downhole operation. Thereafter, sacrificial material portion 231 is removed, such as through one or more of the methods described above, to provide third profile 241 (FIG. 7). As a result, a second downhole tool can be run into wellbore tubular 232 to engage profiles 238, 239, and third profile 241 so that a second downhole operation can be performed.

In yet another embodiment shown in FIGS. 8A-8D, downhole device 330 is shown disposed within wellbore 332 which comprises inner wellbore wall surface 334 and bore 336. Downhole device 330 includes first portion 342, second portion 344, and third portion 345 so that downhole device 330 has a first configuration which, in this embodiment, is a bridge plug. In the embodiment shown in FIGS. 8A-8D, second portion 344 and third portion 345 both comprise a sacrificial material which may or may not be the same type of sacrificial material.

Figure 8B:
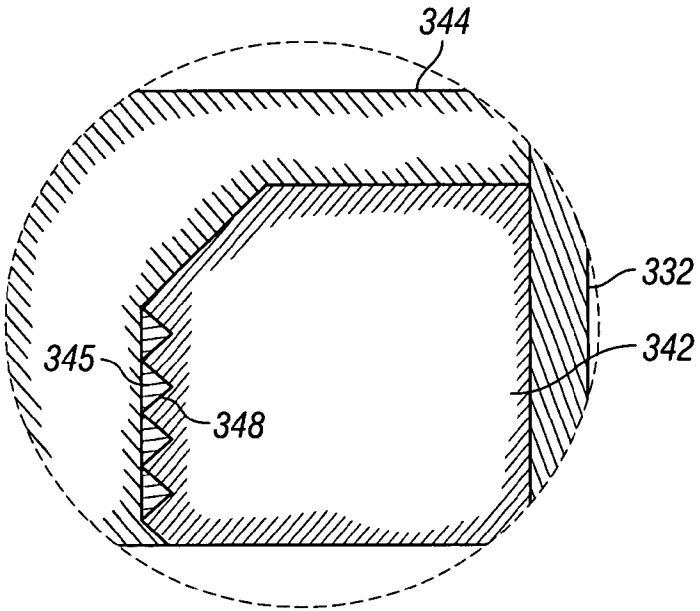
FIG. 8B is an enlarged cross-sectional view of the circled portion of the downhole device of FIG. 8A.
Figure 8A:
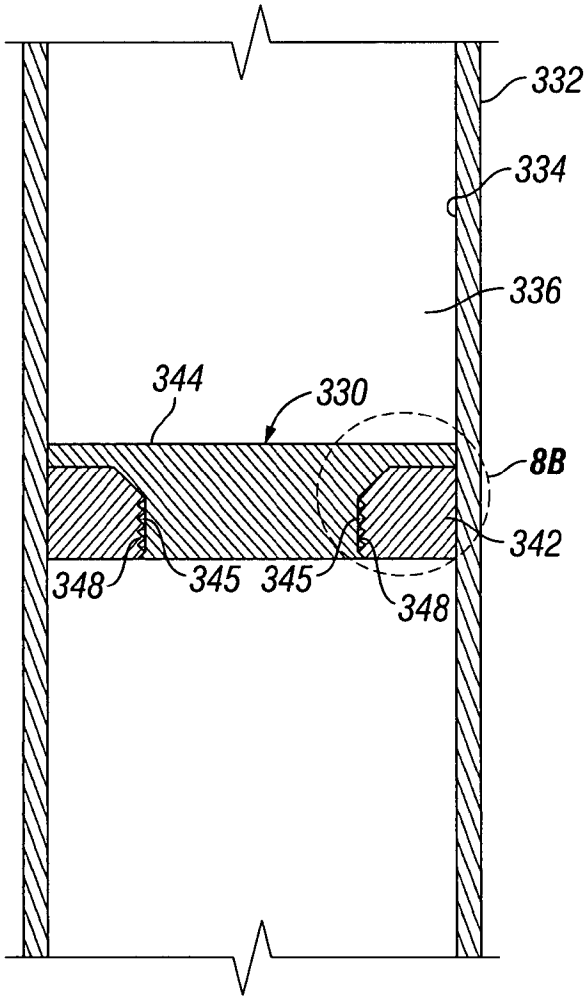
FIG. 8A is a cross-sectional side view of another specific embodiment of a downhole device disposed in a wellbore, the downhole device being shown as having two sacrificial materials and first configuration so that a first downhole operation is performable.
Figure 8D:
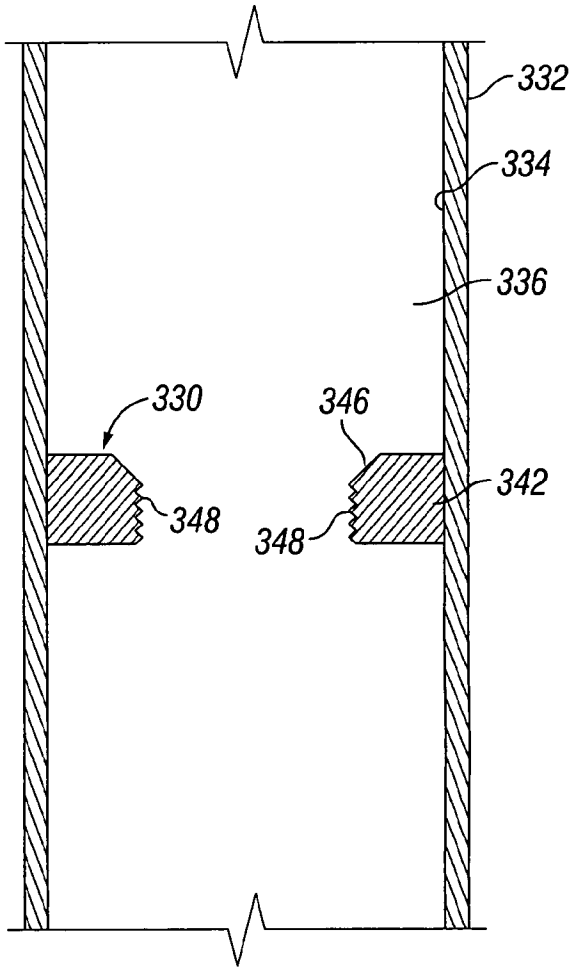
FIG. 8D is a cross-sectional side view of the downhole device of FIG. 8A disposed in a wellbore, the downhole device being shown as having a third configuration after removal of a second sacrificial material so that a third downhole operation is performable.
Figure 8C:
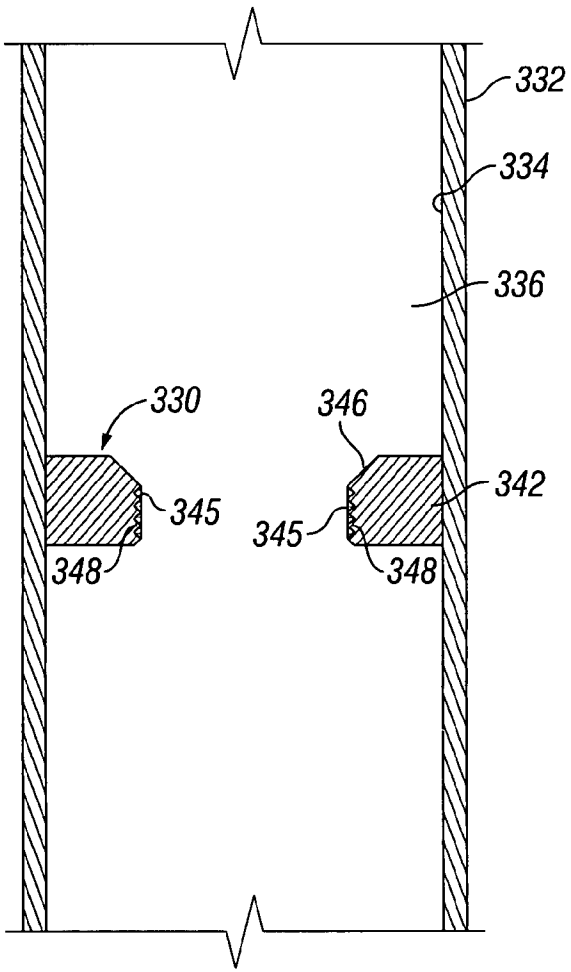
FIG. 8C is a cross-sectional side view of the downhole device of FIG. 8A disposed in a wellbore, the downhole device being shown as having a second configuration after removal of a first sacrificial material so that a second downhole operation is performable.

After the bridge plug downhole device 330 has performed its function or operation within the wellbore, instead of milling out the downhole device 330, second portion 344 is removed such as through the dissolution of the sacrificial material which makes up at least a portion of second portion 344. Upon removal of the sacrificial material of second portion 344, only first portion 342 and third portion 346 remain (FIG. 8C). In the embodiment of FIGS. 8A-8D, first portion 342 includes landing surface or seat 346 (shown best in FIG. 8C) for receiving a plug or ball (not shown). Thus, after removal of second portion 344, downhole device 330 comprises a second configuration so that a second downhole operation or function can be performed.

Thereafter, third portion 345 is removed such as through the dissolution of the sacrificial material which makes up at least a portion of third portion 345. Upon removal, first portion 342, which comprises one or more of fasteners 348 that are initially blocked by third portion 345 (see FIGS. 8A, 8B, 8C), comprises a third configuration of downhole device 330 (FIG. 8D). In other words, upon removal of the sacrificial material of third portion 346, fasteners 348 of first portion 342 are exposed. Thus, after removal of third portion 346, downhole device 330 comprises a third configuration so that a third downhole operation or function can be performed. For example, fastener 348 may be used to connect a downhole component such as a downhole tool, e.g., a cross-over tool, to facilitate anchoring the downhole component within bore 336 of wellbore 332.

It is to be understood that the invention is not limited to the exact details of construction, operation, exact materials, or embodiments shown and described, as modifications and equivalents will be apparent to one skilled in the art. For example, the sacrificial material is not required to be completely removed before a second operation can be performed. Additionally, the first operation and the second operation can be the same type of operation. For example, the first operation may be landing a ball on a ball seat having an opening diameter of 1 inch and the second operation, after sufficient removal of the sacrificial material, landing a second larger ball on a ball seat having an opening diameter of 2 inches. Further, the downhole devices may be designed to perform three or more operations upon one, two, or more removals of one, two, or more sacrificial materials. Moreover, although FIG. 3 shows the first portion has having a landing surface similar to the one shown in FIG. 3, the landing surface is not required. Additionally, the first portion and the second portion may be axially or radially contiguous with each other, they may be formed integral with each, or they may be physically connected to each other such as through threads. Further, the type of operations performable by the downhole devices are not limited to ball seats and bridge plugs. The downhole devices can be designed to perform any number of downhole operations. In addition, wellbore tubulars 132, 232 may be casing or other tubular device disposed within an oil or gas wellbore. Accordingly, the invention is therefore to be limited only by the scope of the appended claims.

What is claimed is:

1. A downhole device comprising:

an immobile structural component, the immobile structural component comprising a first sacrificial material, a first configuration in which the immobile structural component is capable of performing a first operation, and a second configuration in which the immobile structural component is capable of performing a second operation, the second configuration being formed after removal of at least a portion of the sacrificial material from the immobile structural component, wherein the first configuration comprises a bridge plug, and wherein the second configuration comprises a ball seat.

2. The downhole device of claim 1, wherein the immobile structural component further comprises a first portion, the first portion comprising the first sacrificial material, and a second portion, wherein, the first portion and the second portion are arranged in the first configuration and, upon removal of at least a portion of the first sacrificial material, the immobile structural component comprises the second configuration.

3. The downhole device of claim 2, wherein the second portion comprises a second sacrificial material.

4. The downhole device of claim 3, wherein the first sacrificial material is different from the second sacrificial material.

5. The downhole device of claim 4, wherein the first sacrificial material comprises an energetic material.

6. The downhole device of claim 5, wherein the second sacrificial material comprises a frangible material.

7. The downhole device of claim 3, wherein the first sacrificial material comprises a first fluid sacrificial material and the second sacrificial material comprises a second fluid sacrificial material, wherein the first sacrificial material is removed by a first fluid faster than the second sacrificial material is removed by a second fluid.

8. The downhole device of claim 7, wherein the first fluid and the second fluid are the same.

9. The downhole device of claim 2, wherein the second portion comprises a non-sacrificial material.

10. The downhole device of claim 1, wherein the sacrificial material comprises an energetic material.

11. The downhole device of claim 1, wherein the sacrificial material comprises a frangible material.

12. The downhole device of claim 1, wherein the sacrificial material comprises a fluid sacrificial material.

13. The downhole device of claim 1, wherein the sacrificial material comprises a fusible material.

14. The downhole device of claim 1, wherein the second operation is different from the first operation.

15. A method of performing at least two downhole operations using a downhole device, the method comprising the steps of:

(a) disposing a downhole device within a wellbore, the downhole device comprising an immobile structural component, the immobile structural component comprising a sacrificial material and a first configuration;

(b) performing a first operation in the wellbore with the immobile structural component in the first configuration;

(c) removing a portion of the sacrificial material to form a second configuration of the immobile structural component; and (d) performing a second operation in the wellbore with the immobile structural component in the second configuration, wherein the immobile structural component further comprises a second sacrificial material that is removed after step (d) to form a third configuration of the immobile structural component, and a third operation is performed in the wellbore with the immobile structural component in the third configuration.

16. The method of claim 15, wherein step (c) is performed by activating an energetic material.

17. The method of claim 15, wherein step (c) is performed by contacting the sacrificial material with a fluid.

18. The method of claim 15, wherein step (c) is performed by fracturing the sacrificial material.

19. The method of claim 15, wherein step (c) is performed by combusting the sacrificial material.

20. The method of claim 15, wherein the first operation and the second operation comprise the same type of operation.

* * * * *